US006293760B1

(12) United States Patent
Pais et al.

(10) Patent No.: US 6,293,760 B1
(45) Date of Patent: Sep. 25, 2001

(54) PUMP AND MOTOR UNIT AND METHOD FOR PUMPING FLUIDS

(75) Inventors: Martin R. Pais, North Barrington; Maninder S. Sehmbey, Wheeling, both of IL (US); Jim Cathey, Lexington, KY (US)

(73) Assignee: Motorola, Inc., Schaumburg, IL (US)

( * ) Notice: Subject to any disclaimer, the term of this patent is extended or adjusted under 35 U.S.C. 154(b) by 0 days.

(21) Appl. No.: 09/525,214

(22) Filed: Mar. 14, 2000

(51) Int. Cl.[7] ..... F04B 19/24; F04B 17/00

(52) U.S. Cl. ..... 417/53; 417/424.1; 417/356

(58) Field of Search ..... 417/53, 410.1, 417/351, 424.1, 423.7, 423.1, 356, 3, 10

(56) References Cited

U.S. PATENT DOCUMENTS 5,692,882 * 12/1997 Bozeman, Jr. et al. ..... 417/356
5,832,986 * 11/1998 Kenny et al. ..... 165/80.3
6,019,165 * 2/2000 Batchelder ..... 165/80.3
6,100,618 * 8/2000 Schoeb et al. ..... 417/356
6,149,404 * 11/2000 Dobler et al. ..... 417/356

FOREIGN PATENT DOCUMENTS 11-210668 * 8/1999 (JP) ..... F04D/13/02

* cited by examiner

*Primary Examiner*—Charles G. Freay
*Assistant Examiner*—Michael K. Gray
(74) *Attorney, Agent, or Firm*—Steven A. May

(57) ABSTRACT

A pump and motor unit 100 and method for pumping fluid is provided. The pump and motor unit 100 has a rotor element 102 which provides both pumping force and motor force. The rotor element 102 contains a fluid flow channels 200 which pump the fluid through the pump and motor 100 when rotated using centrifugal pump principles. The rotor element 102 further includes magnets 108, preferably permanent magnets, which generate a rotor magnetic field. First and second stator seconds 104 and 106 generate a stator magnetic field using coils 300–314. The rotor and stator magnetic fields interact and generate a torque which rotates the rotor element 102 using brushless DC motor principles.

21 Claims, 2 Drawing Sheets

PUMP AND MOTOR UNIT AND METHOD FOR PUMPING FLUIDS

BACKGROUND OF THE INVENTION

The present invention relates generally to pumps and methods for pumping fluids and, more particularly, to a pump and motor unit and method for cooling of electronics.

As electronic components continue to become smaller and smaller with more and more functionality, they become increasingly sensitive to changes in temperature, and more particularly, to heat generated by their operation. Accordingly, systems for cooling electronic components have been developed in the art. For example, a simple fan driven by an electric motor, has been used to force air over electronic components for cooling. In addition, finned heat sink devices have been connected to electronic components, thereby increasing the surface area of the component from which heat is dissipated.

An additional method of cooling electronic components involves the use of compact, miniature pump and motor systems which pump dielectric fluids over high heat flux electronics. These systems desirably produce a low flow rate at a high pressure. Current motor and pump systems have various designs incorporating a variety of technologies. For example, DC motors, brushless DC motors, AC motors and switched reluctance motors (SRMs) have been used to power the pump. Various types of pumps, such as gear pumps, have been advantageously employed. However, further improvements in efficiency of operation and a reduction in size of these motor and pump systems are needed in the art.

Accordingly, this need is met by a pump and motor unit and method of the present invention which incorporates a motor and pump into a single unit, which employs centrifugal pump technology and which uses a rotor element for both pumping force generation and motor rotation.

BRIEF DESCRIPTION OF THE DRAWINGS

The foregoing and other advantages of the invention will become apparent upon reading the following detailed description and upon reference to the drawings in which.

DETAILED DESCRIPTION OF THE PREFERRED EMBODIMENT

In accordance with one aspect of the present invention, a pump and motor unit for pumping fluid is provided in which a rotor element operates as both a rotor for the motoring function and a pump impeller for the pumping function. The pump and motor unit comprises a rotor element for forcing fluid into and out of the pump and motor unit and for generating a rotor magnetic field and a stator assembly for generating a stator magnetic field which interacts with the rotor magnetic field to move the rotor element to force the fluid into and out of the pump.

The rotor element may have one or more magnets mounted thereon for generating the rotor magnetic field. Preferably, the rotor element is rotatably mounted between a first and second stator section of the stator assembly, in a "pancake" type arrangement. The rotor element may include one or more fluid flow channels which generate a centrifugal force to pump the fluid when the rotor element is rotated.

In accordance with another aspect of the present invention, a pump and motor unit for pumping a fluid is provided. A rotor element includes at least one magnet for generating a rotor magnetic field and at least one fluid flow channel for generating a centrifugal force which forces fluid into and out of the pump and motor unit when the rotor element is moved, or preferably rotated. A stator generates a stator magnetic field which interacts with the rotor magnetic field to cause the rotor element to move.

Figure 1:
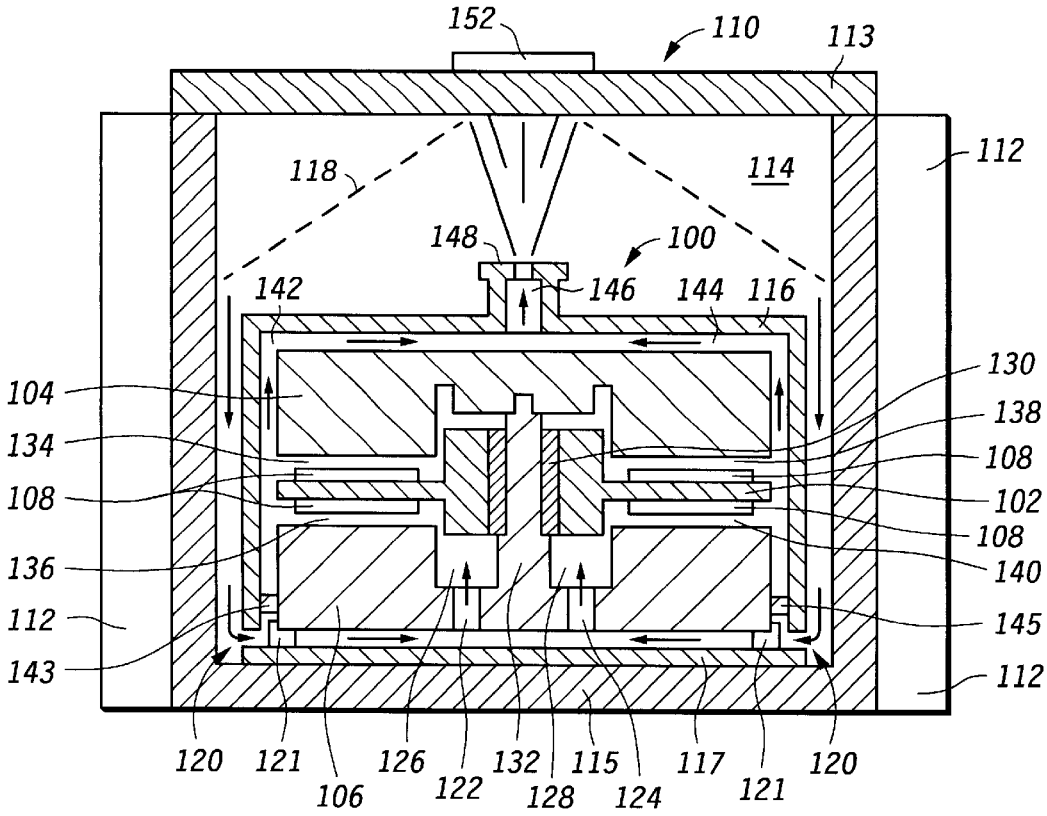
FIG. 1 is a cross sectional view of a pump and motor unit having a rotor element and first and second stator sections encased in a enclosure in accordance with the present invention.

In accordance with yet another aspect of the present invention,

FIG. 1 is a cross sectional view of a pump and motor unit 100 in accordance with the present invention. FIG. 2 is an exploded view of the pump and motor unit 100. The pump and motor unit 100 includes a rotor element 102 which is rotatably mounted between a first, or top, stator section 104 and a second, or bottom, stator section 106. The first and second stator sections 104 and 106 comprise a stator assembly. The rotor element 102 is preferably interposed between the first and second stator sections 104 and 106, in a sandwich type design. A plurality of magnets 108 are mounted on the rotor element 102. As discussed more fully below, the first and second stator sections 104 and 106 generate a revolving magnetic field which interacts with a rotor magnetic field generated by the magnets 108 causing the rotor element 102 to move and, more particularly, to rotate.

The pump and motor unit 100 may be enclosed in an enclosure 110 which is preferably fabricated from aluminum. The enclosure 110 may include a plurality of cooling fins 112 which help cool the fluid and the pump and motor unit 100. A device to be cooled, such as a laser diode-power chip 152, may be mounted on a top cover 113 of the enclosure 110. Fluid pumped by the pump and motor unit 100 flows against the under surface of the power chip 152 or the area of the top cover 113 on which the power chip 152 is mounted to cool the power chip 152.

The enclosure 110 includes a bottom cover 115. As those skilled in the art will readily appreciate, the top cover 113, the bottom cover 115 and the cooling fins 112 may be manufactured as one piece or a plurality of pieces. A pump-motor casing 116 of the pump and motor unit 100 has an input opening 120 generally along its bottom for permitting fluid to enter the casing 116. The input opening 120 may be formed between a bottom plate 117 and the casing 116. The second stator 106 sits on a pair of mounts 121 to form the opening 120. The input opening 120 may be one or more holes in the casing 116. The fluid enters the input opening 120 and is directed to two inlets 122 and 124. The inlets 122 and 124 enter into respective chambers 126 and 128. As will be apparent to those skilled in the art, chambers 126 and 128 is preferably a single chamber in which the rotor element 102 is rotatably mounted. In particular, the rotor element 102 is mounted on a bearing 130, preferably a nyliner bearing, which is mounted on a shaft 132. Although the shaft 132 may be a separately manufactured part, it is preferably formed out of the second stator section 106.

Figure 2A:
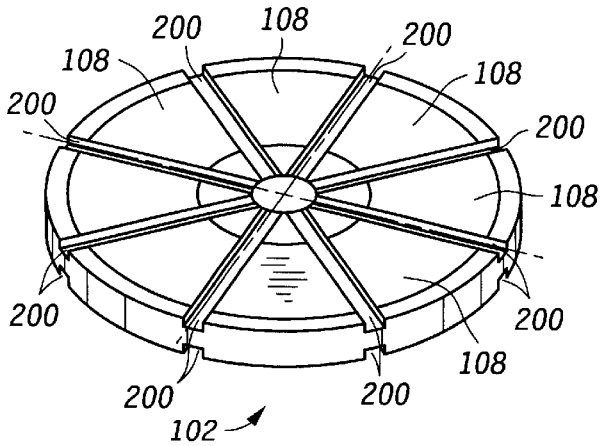
FIG. 2*a* is a perspective view of the rotor element shown in FIG. 1.

The fluid flows from the chambers 126 and 128 through one or more fluid flow channels 200, shown in FIG. 2*a,* formed in the rotor element 102. Due to centrifugal force generated by the rotating rotor element 102, the fluid is forced from the fluid flow channels 200 and pumped out of the chambers 126 and 128 through passageways 134, 136, 138 and 140 adjacent the magnets 108. Exit passageways 142 and 144 then transport the fluid into an exit chamber 146 and out a nozzle 148. The exit passageways 142 and 144 are isolated from the input opening 120 via respective blocks 143 and 145. The nozzle 148 directs the pumped fluid onto the portion of the top cover 113 under the power chip 152. The fluid is then partially guided back to the input opening 120 by a conical screen 118.

It should be understood that the present invention may have fluid flow passageways which differ from those shown in FIG. 1. For example, passageways could be placed in the bottom cover 115 for permitting fluid flow into the pump and motor unit 100.

Figure 2B:
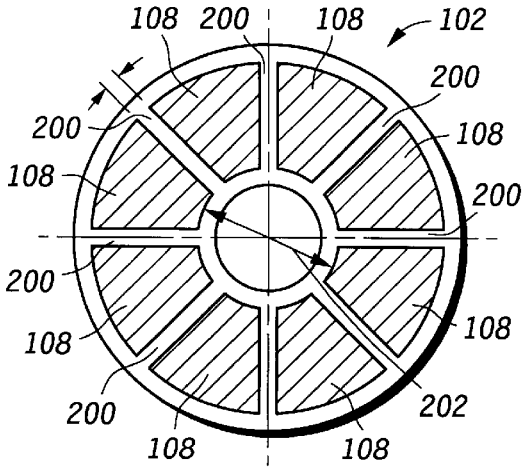
FIG. 2*b* is a plan view of the rotor element shown in FIG. 1.

FIGS. 2*a* and 2*b* are respectively perspective and plan views of the rotor element 102. The magnets 108 which generate the rotor magnetic field are mounted on the rotor element 102 in a general pie shaped fashion. The fluid flow channels 200 are formed in the rotor element 102 between adjacent magnets 108. As those skilled in the art will readily comprehend, other magnet and channel placements may also be employed in the present invention. Preferably, the magnets 108 are permanent magnets mounted on the rotor element 102. The magnets 108 could be incorporated into the material of the rotor element 102 or separately made and mounted thereon. In this preferred embodiment, there are eight magnets uniformly spaced around the rotor element 102. The fluid flow channels 200 extend outwardly from a center mounting hole 202 in the rotor element 102. The bearing 130 and the shaft 132 are positioned in the center mounting hole 202 when assembled.

Figure 3A:
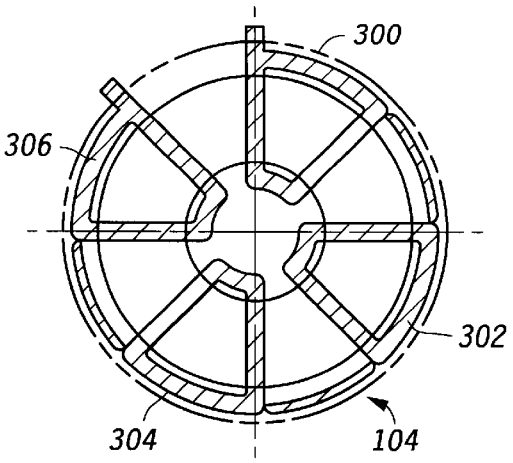
FIG. 3*a* is a plan view of the first stator section shown in FIG. 1.
Figure 3B:
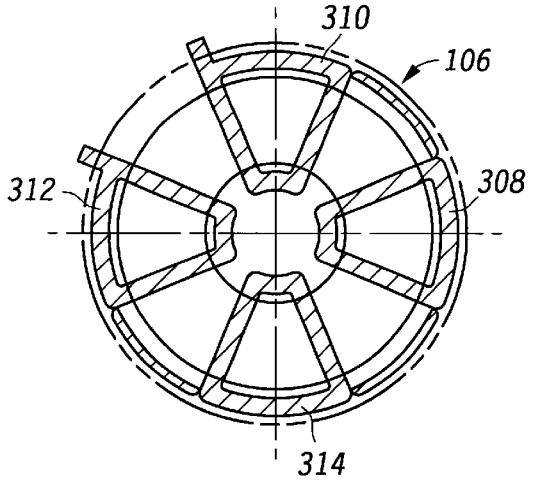
FIG. 3*b* is a plan view of the second stator section shown in FIG. 1.

FIGS. 3*a* and 3*b* are plan views of the respective first and second stator sections 104 and 106. In particular, sides of the respective first and second stator sections 104 and 106 which are adjacent the rotor element 102 are shown. The first, or top, stator section 104 has four top coils 300, 302, 304 and 306 and the second, or bottom, stator section 106 has four bottom coils 308, 310, 312 and 314. Each of the coils 300, 302, 304, 306, 308, 310, 312 and 314 are preferably uniformly positioned around the perimeter of its respective stator section 104 or 106. The bottom coils 308, 310, 312 and 314 are rotated approximately one half a coil from the top coils 300, 302, 304 and 306. By passing current through the coils 300 through 314 the magnetic torque produces by each coil will be out of phase with each other. For purposes of this disclosure, the top coils 300, 302, 304 and 306 are designated as phase 1 and the bottom coils 308, 310, 312 and 314 are designated as phase 2. The top and bottom coils 300 through 314 comprise a stator magnetic field circuit which produces phase 1 and phase 2 torques. The generated stator magnetic field and the rotor magnetic field interact to rotate the rotor element 102.

The interaction of the stator and rotor magnetic fields to rotate the rotor element 102 uses known brushless DC motor technology and, therefore, will be briefly discussed herein. For example, if a square wave is input into the top coils 300, 302, 304 and 306, the torque ($T_1$) produced will follow a trapezoidal shaped curve over the degree of rotation. Since the coils of the respective stator sections 104 and 106 are rotated with respect to each other, the torque ($T_2$) produced when the square wave is applied to the bottom coils 308, 310, 312 and 314 follows a trapezoidal shaped curve over the degree of rotation, but is offset to the torque generated by the top coils 300, 302, 304 and 306.

While the invention may be susceptible to various modifications and alternative forms, specific embodiments have been shown by way of example in the drawings and have been described in detail herein. However, it should be understood that the invention is not intended to be limited to the particular forms disclosed. Rather, the invention is to cover all modification, equivalents and alternatives falling within the spirit and scope of the invention as defined by the following appended claims.

What is claimed is:

1. A pump and motor unit for pumping fluid comprising:

a rotor element for forcing fluid into and out of the pump and motor unit and for generating a rotor magnetic field;

a stator assembly comprising a first stator section and a second stator section for generating a stator magnetic field which interacts with the rotor magnetic field to move the rotor element to force the fluid into and out of the pump; and wherein the first stator section is axially adjacent to a first side of the rotor element and the second stator section is axially adjacent to a second side of the rotor element.

2. The pump and motor unit as recited in claim 1 wherein the rotor element comprises:

at least one magnet for generating the rotor magnetic field.

3. The pump and motor unit as recited in claim 1 wherein the rotor element rotates in a direction substantially perpendicular to the fluid flow through the pump and motor unit.

4. The pump and motor unit as recited in claim 1 wherein the rotor element comprises:

a fluid flow channel through which the rotor element forces the fluid into and out of the pump and motor unit.

5. The pump and motor unit as recited in claim 1 wherein the stator assembly comprises:

a stator magnetic field circuit for generating the stator magnetic field using current having at least two phases.

6. The pump and motor unit as recited in claim 5 wherein the stator magnetic field circuit comprises a plurality of wedge-shaped coils mounted on the first and second stator sections.

7. The pump and motor unit as recited in claim 1, wherein the rotor element rotates in a plane that is disposed between the first stator section and the second stator section.

8. The pump and motor unit as recited in claim 1, wherein the stator magnetic field is axially oriented.

9. The pump and motor unit as recited in claim 4, wherein the fluid flow channel is radially oriented in the rotor element.

10. A method for pumping fluid through a pump and motor unit comprising the steps of:

moving a rotor element to force fluid into and out of the pump and motor unit;

generating a rotor magnetic field by the rotor element;

generating, by a stator element, a stator magnetic field which interacts with the rotor magnetic field to cause the rotor element to rotate; and wherein the stator element comprises a first stator section that is axially adjacent to a first side of the rotor element and a second stator section that is axially adjacent to a second side of the rotor element.

11. The method as recited in claim 10 wherein the step of generating a rotor magnetic field comprises the step of:

providing the rotor element with at least one magnet.

12. The method as recited in claim 10 wherein the step of moving a rotor element comprises the step of:

providing a fluid flow channel in the rotor element which generates a centrifugal force to pump the fluid when the rotor element is moved.

13. The method as recited in claim 8, wherein the rotor element rotates in a plane that is disposed between the is first stator section and the second stator section.

14. A pump and motor unit for pumping fluid comprising:

a rotor element comprising at least one magnet for generating a rotor magnetic field and at least one fluid flow channel for generating a centrifugal force which forces fluid into and out of the pump and motor unit when the rotor element is moved, wherein the at least one fluid flow channel is radially oriented in the rotor element; and a stator for generating a stator magnetic field which interacts with the rotor magnetic field to cause the rotor element to rotate.

15. The pump and motor unit as recited in claim 14 wherein the rotor element is rotatably mounted in the pump and motor unit.

16. The pump and motor unit as recited in claim 14, wherein the stator comprises:

a first stator section disposed axially adjacent to a first side of the rotor element;

a second stator section disposed axially adjacent to a second side of the rotor element; and wherein the rotor element rotates in a plane that is disposed between the first stator section and the second stator section.

17. The pump and motor unit as recited in claim 16 wherein the first stator comprises a plurality of coils through which a square wave current is passed to generate a portion of the stator magnetic field.

18. The pump and motor unit as recited in claim 16 wherein the rotor element comprises a bearing on which the rotor element rotates.

19. The pump and motor unit as recited in claim 18 wherein the bearing is a nyliner bearing.

20. The pump and motor unit as recited in claim 14, wherein the stator magnetic field is axially oriented.

21. A method for pumping fluid through a pump and motor unit comprising the steps of:

moving a rotor element to force fluid into and out of the pump and motor unit;

generating a rotor magnetic field by the rotor element; and generating an axially-oriented stator magnetic field which interacts with the rotor magnetic field to cause the rotor element to move.

* * * * *

UNITED STATES PATENT AND TRADEMARK OFFICE

CERTIFICATE OF CORRECTION

PATENT NO. : 6,293,760 B1
DATED : September 25, 2001
INVENTOR(S) : Pais et al.

It is certified that error appears in the above-identified patent and that said Letters Patent is hereby corrected as shown below:

Column 5,
Line 6, reads "claim 8", should be -- claim 10 --

Signed and Sealed this

Fourteenth Day of May, 2002

*Attest:*

*Attesting Officer*

JAMES E. ROGAN
*Director of the United States Patent and Trademark Office*